United States Patent [19]

Lyerly

[11] Patent Number: 4,460,209

[45] Date of Patent: Jul. 17, 1984

[54] FIXTURE FOR REMOVING A TURBINE DISC WITHOUT REMOVING BLADES THEREFROM

[75] Inventor: Jack N. Lyerly, Belmont, N.C.

[73] Assignee: Westinghouse Electric Corp., Pittsburgh, Pa.

[21] Appl. No.: 327,158

[22] Filed: Dec. 3, 1981

[51] Int. Cl.[3] ..... B66C 1/30

[52] U.S. Cl. ..... 294/67 BC

[58] Field of Search ..... 294/67 BC, 67 BB, 67 B, 294/67 R, 62, 63 R, 81 R, 106, 116, 117

[56] References Cited

U.S. PATENT DOCUMENTS

| | | | |
|---|---|---|---|
| 2,820,664 | 1/1958 | Mende | 294/67 BC |
| 2,946,618 | 7/1960 | Klahn et al. | 294/67 BC |
| 3,020,078 | 2/1962 | Roy | 294/67 BC |
| 4,105,240 | 8/1978 | Steenson | 294/67 BC |

*Primary Examiner*—James B. Marbert

*Attorney, Agent, or Firm*—F. J. Baehr, Jr.

[57] ABSTRACT

A fixture for lifting turbine discs without removing blades therefrom has a ringed-shaped base and a plurality of upper arms which extend radially outwardly and downwardly from the base. Each upper arm portion has a lower arm portion pivotally connected thereto so that the lower arm portion remains generally parallel to the base as it pivots and pivots back underneath the upper arm portion. The lower arm portions each have telescoping members which telescope in and out of their distal end to support different size discs.

8 Claims, 2 Drawing Figures

FIXTURE FOR REMOVING A TURBINE DISC WITHOUT REMOVING BLADES THEREFROM

BACKGROUND OF THE INVENTION

This invention relates to steam turbines and more particularly to a fixture for lifting turbine discs without removing blades therefrom.

As turbines became larger the rotors for the low pressure end increased in diameter to such an extent that the shaft could not be formed as a single forging so that it became standard practice to build up the rotor by shrinking a plurality of discs on each end of a step shaft. In order to prevent any rotation between the disc and the shaft at high speeds or during thermal gradience, the discs were keyed to the shaft. In time, due to stress concentrations and stess corrosion, cracks began to appear in the keyways necessitating removal, repair and replacement of the discs.

SUMMARY OF THE INVENTION

In general, a fixture for lifting turbine discs without removing blades, when made in accordance with this invention, comprises a base with a centrally disposed opening, a plurality of arms fixed and extending generally radially from the base. The arms have an upper portion and a lower portion. The lower portion is pivotally connected to the upper portion in such a manner that the lower portion remains generally parallel to the base as it pivots and pivots back under the upper portion to support the disc inboard of the blades.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
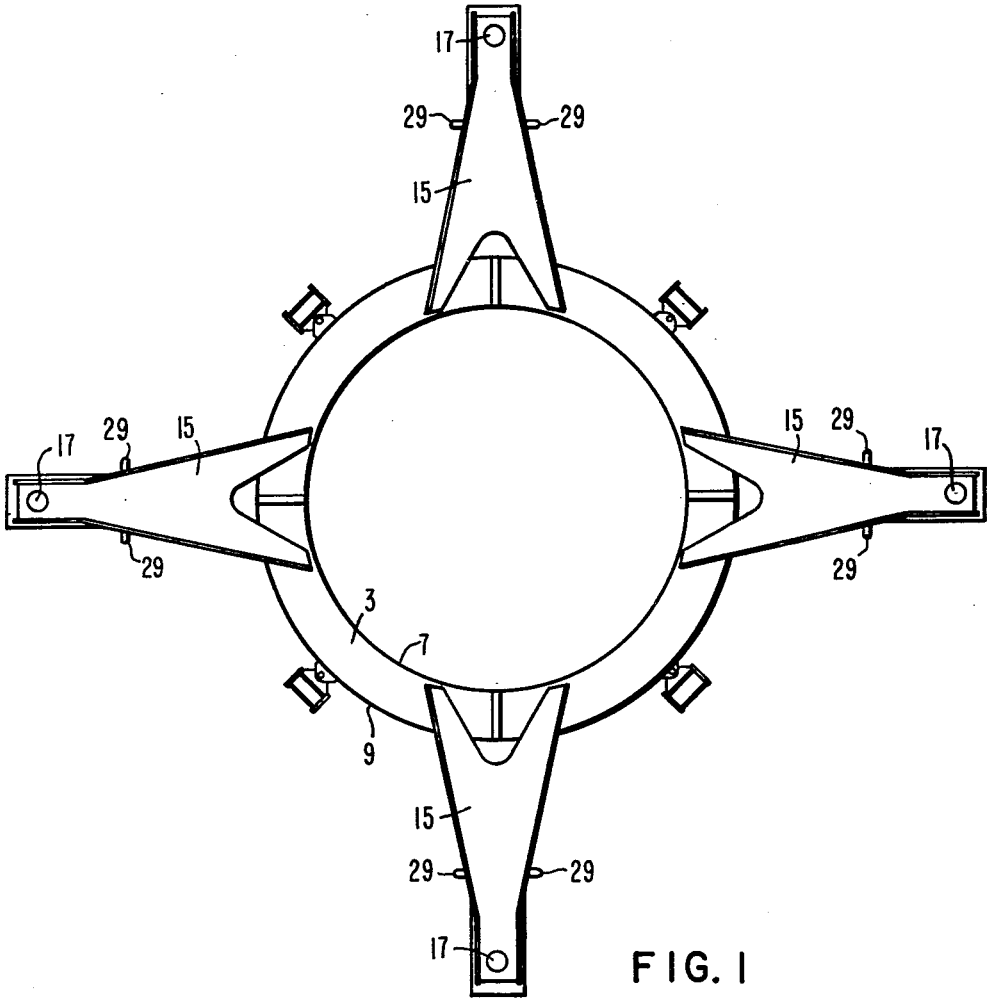
FIG. 1 is a plan view of a turbine disc lifting fixture made in accordance with this invention.
Figure 2:
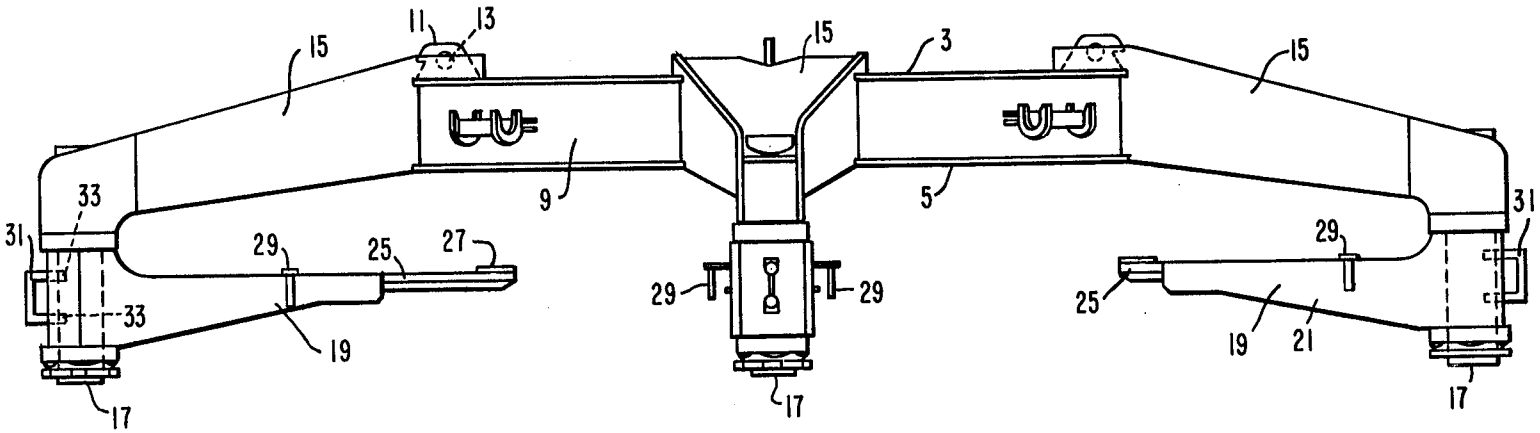
FIG. 2 is an elevational view of the fixture.

Referring now to the drawings in detail there is shown a fixture for lifting a turbine disc without removing blades therefrom. The fixture comprises a base 1 formed in the shape of a ring having a centrally disposed opening. Top and bottom arcuate plates 3 and 5 are welded together and two inner and outer webs 7 and 9 to form a circular box beam or ring. Plates 11 with hole 13 are welded to the base to provide means for attaching a cable to the base for lifting it with a hoist or other lifting device (not shown). A plurality of upper arm portions 15 are welded to the base 1 and extend radially outwardly and slightly downwardly therefrom. A pin 17 is welded to the distal end of the upper arm portions and extends downwardly therefrom. A lower arm portion 19 is pivotally mounted on the pin 17 in such a manner that the lower arm portion 19 remains generally parallel to the base 1 as it pivots about the pin 17 and pivots back under the upper arm portion 15 to support a turbine disc inboard of the blades. The upper arm portions 15 are box beams which taper downwardly slightly as they extend toward their distal end. The lower arm portions 19 have side plates 21 with longitudinal grooves disposed therein. A telescoping member 25 is generally a stubby T-shaped member with the cross portion fitting into the grooves in the side plates 21 to allow it to telescope or slide in and out of the distal end of the lower arm portion 19. The telescoping members 25 have pads 27 on their distal ends for supporting a turbine disc and also have handles 29 for sliding or telescoping the telescoping portion in and out of the lower arm portion to fit a particular disc. The lower arm portion 19 also has pins 31 which engage holes 33 in the pin 17 to latch the lower arm portion 19 directly under the upper arm portion 15.

The lifting fixtures hereinbefore described advantageously fit over the disc while they are stacked on the rotor without removing any blades and are so made that they can be placed in a furnace with the disc in order to heat the disc prior to installing it on the rotor.

What is claimed is:

1. A fixture for lifting turbine discs without removing blades therefrom, said fixture comprising:

a base with a centrally disposed opening;

a plurality of arms affixed to and extending generally radially from said base;

said arms having an upper portion and a lower portion;

said lower portion being pivotally connected to said upper portion in such a manner that said lower portion always remains generally parallel to said base as it pivots and that said lower portion pivots back under said upper arm portion to support said disc;

said lower arm portion having a telescoping member on its distal end; and said telescoping member having a pad for supporting said disc inboard of said blades.

2. A fixture as set forth in claim 1, wherein the base is a ring.

3. A fixture as set forth in claim 1, wherein the lower arm portions have pins which lock them in place directly under the upper arm portions.

4. A fixture as set forth in claim 1, wherein the base has plates with holes extending therefrom for attaching cables for lifting the fixture.

5. A fixture as set forth in claim 1, wherein the arm portions are generally tapered downwardly toward their distal ends.

6. A fixture as set forth in claim 1, wherein the upper arm portions also extend slightly downwardly from the base.

7. A fixture as set forth in claim 1, wherein the upper and lower arm portions cooperate to provide a space below the base for a disc.

8. A fixture as set forth in claim 1, wherein the telescoping portion of the lower arm portion has handles for telescoping in and out to fit various discs.

* * * * *